US007215896B2

(12) United States Patent
Yamada et al.

(10) Patent No.: US 7,215,896 B2
(45) Date of Patent: May 8, 2007

(54) IMAGE FORMING APPARATUS AND METHOD OF DETECTING THE DETECTION CHARACTERISTICS OF A REFLECTION DENSITY SENSOR

(75) Inventors: Shintaro Yamada, Chiyoda (JP); Akira Shimada, Hitachi (JP); Tatsunari Sato, Tsuchiura (JP); Nobuaki Fukasawa, Hitachi (JP); Satoshi Narita, Hitachiota (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 0 days.

(21) Appl. No.: 10/901,187

(22) Filed: Jul. 29, 2004

(65) Prior Publication Data

US 2005/0025510 A1 Feb. 3, 2005

(30) Foreign Application Priority Data

Jul. 30, 2003 (JP) ..... 2003-282989

(51) Int. Cl.
*G03G 15/00* (2006.01)

(52) U.S. Cl. ..... 399/49; 399/72

(58) Field of Classification Search ..... 399/30, 399/62, 64, 49, 72

See application file for complete search history.

(56) References Cited

U.S. PATENT DOCUMENTS 5,103,260 A * 4/1992 Tompkins et al. ..... 399/39
5,122,835 A * 6/1992 Rushing et al. ..... 399/49

FOREIGN PATENT DOCUMENTS

JP 1-197777 8/1989
JP 7-225501 8/1995

* cited by examiner

*Primary Examiner*—David M. Gray
*Assistant Examiner*—Laura K Roth
(74) *Attorney, Agent, or Firm*—Antonelli, Terry, Stout & Kraus, LLP.

(57) ABSTRACT

An image forming apparatus is able to form steady test-pattern toner images for calibration of reflection density detection characteristics with ample toner. The operation consists of forming a test-pattern toner image for calibration of the reflection density detection characteristics, which is formed of a plurality of toner images of different colors aside from a reference test-pattern toner image for controlling image forming conditions, detecting the detection characteristics of a reflection density sensor from the result of detection of the quantity of toner attached to the test-pattern toner image for calibration of the reflection density detection characteristics, and calibrating the output characteristics of the reflection density sensor.

8 Claims, 5 Drawing Sheets

FIG. 5

(a)

| | 3-LAYER CONFIGURATION | | | |
|---|---|---|---|---|
| | FIRST LAYER | SECOND LAYER | THIRD LAYER | REMARKS (EMPTY) |
| 1 | Y | Y | Y | M,C |
| 2 | Y | Y | M | C |
| 3 | Y | Y | C | M |
| 4 | Y | M | Y | C |
| 5 | Y | M | M | C |
| 6 | Y | M | C | |
| 7 | Y | C | Y | M |
| 8 | Y | C | M | |
| 9 | Y | C | C | M |
| 10 | M | Y | Y | C |
| 11 | M | Y | M | C |
| 12 | M | Y | C | |
| 13 | M | M | Y | C |
| 14 | M | M | M | Y,C |
| 15 | M | M | C | Y |
| 16 | M | C | Y | |
| 17 | M | C | M | Y |
| 18 | M | C | C | Y |
| 19 | C | Y | Y | M |
| 20 | C | Y | M | |
| 21 | C | Y | C | M |
| 22 | C | M | Y | |
| 23 | C | M | M | Y |
| 24 | C | M | C | Y |
| 25 | C | C | Y | M |
| 26 | C | C | M | Y |
| 27 | C | C | C | Y,M |

Y:YELLOW 、 M:MAGENTA 、 C:CYAN (b)

| | 2-LAYER CONFIGURATION | | |
|---|---|---|---|
| | FIRST LAYER | SECOND LAYER | REMARKS (EMPTY) |
| 1 | Y | Y | M,C |
| 2 | Y | M | C |
| 3 | Y | C | M |
| 4 | M | Y | C |
| 5 | M | M | Y,C |
| 6 | M | C | Y |
| 7 | C | Y | M |
| 8 | C | M | Y |
| 9 | C | C | Y,M |

Y:YELLOW 、 M:MAGENTA 、 C:CYAN

IMAGE FORMING APPARATUS AND METHOD OF DETECTING THE DETECTION CHARACTERISTICS OF A REFLECTION DENSITY SENSOR

BACKGROUND OF THE INVENTION

This invention relates to an image forming apparatus, such as a printer, facsimile, copier, and the like, that forms images by use of an electrophotographic method to develop electrostatic latent images with colored particles (toner), and to a method for detecting the detection characteristics of an optical reflection density sensor which is used in the image forming apparatus.

In the electrophotographic image forming field of copiers and laser printers, to stabilize the supply of toner to developers (replacement of developers) and the formation of images, the image forming apparatus forms a reference test pattern for controlling the image forming conditions on a photosensitive element or an intermediate transfer element under a preset operating condition, detects the quantity of toner on the test pattern, controls the supply of toner to the developer or the image forming condition (such as the charging potential, the exposure intensity, and the developing bias on the photosensitive element) and thus controls the quality of the recorded image.

In the steps of detecting the quantity of toner on the test pattern and controlling the image forming conditions, it is important that the detection characteristics of the optical reflection density sensor are stable with time. However, the detection characteristics of the optical reflection density sensor in actual use tend to deteriorate because of time-lapse deterioration of the light emitting diode (LED) that is used as is a light source for illuminating the test pattern and the light receiving photo diode (PD) that is used as a detection element and because of time-lapse contamination of the optical system. To suppress this influence, the detection characteristics of the optical reflection density sensor must be detected before the quantity of attached toner is detected.

One of the known methods for detecting the detection characteristics of the optical reflection density sensor is disclosed in Japanese Application Patent Laid-open Publication Hei 07-225501. Using a calibration reflector as a reference, this method detects the intensity of light reflected by the reflector and effects control to keep the result of detection at a preset value.

Another known detecting method is disclosed in Japanese Application Patent Laid-open Publication Hei 01-197777. Using a reflection density sensor having a characteristic in which the detection output is reduced as more toner attaches, this method forms a high-density test pattern toner image containing 1.5 to 3 times the usual quantity of toner attachment on the toner retainer by increasing the developing bias, detects the quantity of toner attached to the test pattern toner image and corrects the detection output.

Among the conventional methods for detecting the detection characteristics of an optical reflection density sensor, the detection method using a reference calibration reflector requires a driving mechanism for retracting the calibration reflector when the characteristic detection is not being implemented. This increases the required amount of mounting space and the number of parts. Therefore, it is hard to apply this method to a small inexpensive image forming apparatus.

Further, the method which uses a high-density test pattern toner image cannot detect such a high-density test pattern toner image when the high-density test pattern toner image cannot be formed by increasing the developing bias. This decreases the control precision. As one of the reasons why a high-density test pattern image cannot be formed, we can assume that this is due to deterioration of the developing ability of the developers that form the test pattern toner image.

SUMMARY OF THE INVENTION

An object of this invention is to provide a method of detecting the detection characteristics of a high-precision optical reflection density sensor of the type that is suitably applicable to a small inexpensive image forming apparatus and an image forming apparatus using this characteristics detecting method.

In more detail, according to this invention, a test pattern toner image of sufficiently high density is formed and high-precision characteristic detection of the optical reflection density sensor is enabled without using a calibration reflector that must be moved for service and for retraction.

This invention relates to an image forming apparatus comprising an image retainer, a charger, an exposure unit, a plurality of developers, an optical reflection density sensor, and a controller that is designed to control the image retainer, the charger, the exposure unit, and the developers under a preset reference image forming condition to electrophotographically form a reference test-pattern toner image for controlling the image forming condition on the image retainer, to detect the quantity of toner attached to the reference test-pattern toner image (for controlling the image forming condition) from the detection output of the reflection density sensor, and to use the result of detection for control of the succeeding image forming condition. The controller is configured to electrophotographically form a test-pattern toner image for detecting the detection characteristics of the reflection density sensor on the image retainer, to detect the detection characteristics of the reflection density sensor from the detection output of the reflection density sensor that detects the quantity of toner attached to the test pattern toner image (for detecting the detection characteristics of the reflection density sensor), and to calibrate the detection output characteristics of the reflection density sensor according to the result of detection. The controller also is configured to control the image retainer, the charger, the exposure unit, and the developers to form a test-pattern toner image for detecting detection characteristics of the reflection density sensor by superimposing multiple toner images formed by the developers.

The reflection density sensor further comprises a light source which emits invisible light and an element for detecting the invisible light, and the developers are configured to form a color toner image.

One of the developers contains black toner, and the controller effects control to form a black toner image on the top of the toner layers of the test-pattern toner image for calibration of the reflection density detection characteristics.

A method is used for detecting the detection characteristics of a reflection density sensor in an image forming apparatus comprising an image retainer, a charger, an exposure unit, a plurality of developers, an optical reflection density sensor, and a controller that is designed to control the image retainer, the charger, the exposure unit, and the developers to electrophotographically form a test-pattern toner image for detecting the detection characteristics of a reflection density sensor on the image retainer under a preset reference image forming condition, to detect the detection characteristics of the reflection density sensor in accordance with the detection output of the reflection density sensor that detects the quantity of toner attached to the test-pattern toner image (for detecting the detection characteristics of the reflection density sensor), and to calibrate the detection output characteristics of the reflection density sensor from the result of detection. The controller controls the image retainer, the charger, the exposure unit, and the developers to form a test-pattern toner image for detecting the detection characteristics of the reflection density sensor by superimposing multiple toner images formed by the developers.

The reflection density sensor consists of a light source which emits invisible light and an element for detecting the invisible light, and the developers are configured to form a color toner image.

The controller effects control to form a black toner image on the top of the toner layers of the test-pattern toner image for detecting the detection characteristics of the reflection density sensor.

In accordance with this invention, a test-pattern toner image for detection (calibration) of the detection output characteristics of an optical reflection density sensor is produced by superimposing toner images that have been developed by a plurality of developers into an image formed of multiple toner image layers. With this, the image forming apparatus of this invention can obtain toner images having the required quantity of toner. Therefore, this invention can provide a method for detecting the detection characteristics of an optical reflection density sensor that is suitably applicable to a small and inexpensive image forming apparatus and an image forming apparatus using this detection characteristics detecting method.

BRIEF DESCRIPTION OF THE DRAWINGS

FIG. 5 is a control table representing combinations of colors constituting the test-pattern toner image used for detecting the detection characteristics of the reflection density sensor in accordance with this invention.

DESCRIPTION OF THE EMBODIMENTS

The image forming apparatus of this invention consists of an image retainer, a charger, an exposure unit, a plurality of developers, an optical reflection density sensor, and a controller. The controller is designed to control the image retainer, the charger, the exposure unit, and the developers under a preset reference image forming condition to electrophotographically form a reference test-pattern toner image for controlling the image forming condition on the image retainer, to detect the quantity of toner attached to the resulting test-pattern toner image from the detection output of the reflection density sensor, and to use the result of detection for control of the succeeding image forming condition. Further, the controller is designed to control the image retainer, the charger, the exposure unit, and the developers to electrophotographically form a test-pattern toner image for detecting the detection characteristics of the reflection density sensor on the image retainer, to detect the detection characteristics of the reflection density sensor from the detection output of the reflection density sensor that detects the quantity of toner attached to the test pattern toner image (for detecting the detection characteristics of the reflection density sensor), and to calibrate the detection output characteristics of the reflection density sensor in accordance with the result of detection.

The reflection density sensor consists of a light source which emits invisible light and an element for detecting the invisible light. The developers are configured to form a color toner image. The controller controls the image retainer, the charger, the exposure unit, and the developers to form a test-pattern toner image for detecting the detection characteristics of the reflection density sensor by superimposing multiple toner images formed by developers.

[Embodiment 1]

Figure 1:
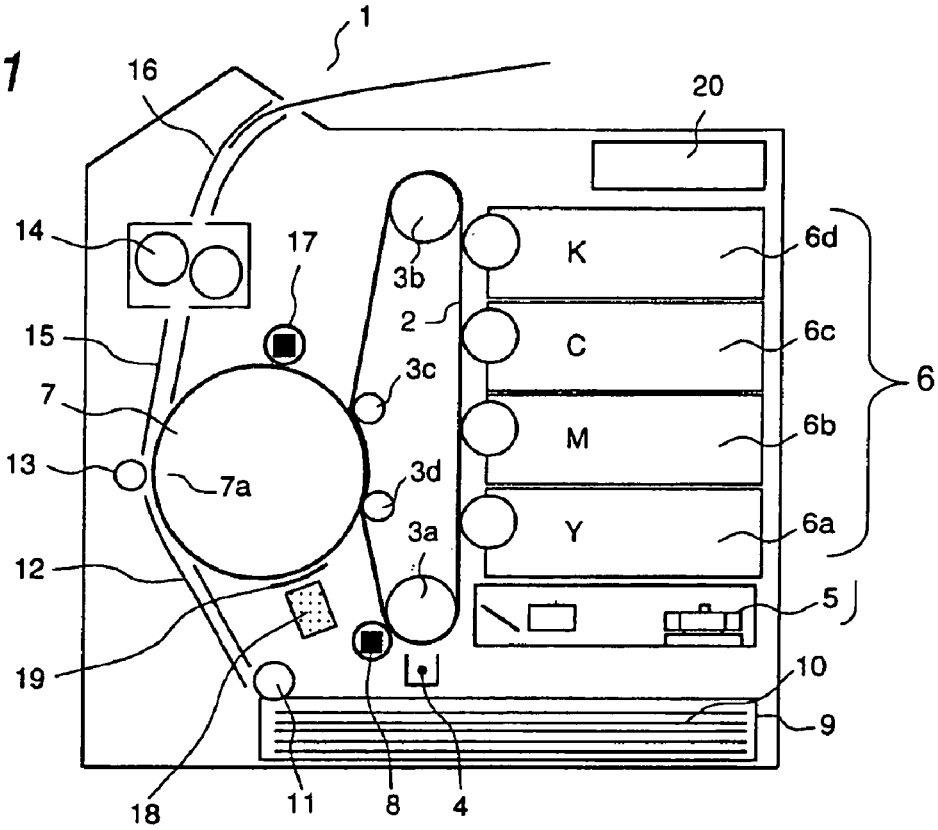
FIG. 1 is a diagrammatic sectional view of an image forming apparatus representing a first embodiment of this invention.

FIG. 1 is a diagrammatic sectional view of an image forming apparatus representing the first embodiment of this invention. This image forming apparatus is configured to transfer a plurality of toner images from an endless photosensitive belt onto the surface of an intermediate transfer drum in a superposition mode to record a single color image.

In FIG. 1, the image forming apparatus 1 is configured as explained below. In the internal side of the endless photosensitive belt 2, which is provided to form toner images of each color, a plurality of guide rollers (3*a* to 3*d*) engage with the belt and allow the belt to move over a predetermined path. On the outer side of the endless photosensitive belt 2, there are a charger 4 which operates to charge the belt surface evenly; a laser exposure unit 5 which operates to apply laser light to the charged surface of the endless photosensitive belt 2 so as to form electrostatic latent images, such as recording images and test pattern images; developers 6 (6*a* to 6*d*) which are respectively provided for each color and which can individually move forward and backward and develop the electrostatic latent images into toner images; an intermediate transfer drum 7, which is located in contact with the endless photosensitive belt 2 between the guide rollers 3*c* and 3*d* and operates to receive toner images from the endless photosensitive belt 2; and a belt cleaner 8 which serves to remove the left-over toner from the endless photosensitive belt 2. A paper feed tray 9 having recording paper sheets 10 is provided on the bottom of the apparatus 1. Each paper sheet 10 is taken up and transported out from the tray 9 by a paper feed roller 11. The paper sheet 10 is then guided by the paper guide 12 into contact with the surface of the intermediate transfer drum 7 at the toner image transfer position 7*a*. A retractable transfer roller 13 is provided at the image transfer position 7*a* to press the paper sheet 10 against the surface of the intermediate transfer drum 7 so as to transfer a toner image from the surface of the intermediate transfer drum 7 onto the paper sheet 10. The transferred toner image on the paper sheet 10 is heated and pressed by a fixer 14. In this case, the paper sheet 10 onto which a toner image has been transferred at the image transfer position 7*a* is guided and fed into the fixer 14 by a fixing guide 15. The paper sheet 10 which carries the fixed image is then guided and ejected to the outside of the apparatus by the paper ejection guide 16. A retractable drum cleaner 17 is provided to remove left-over toner from the surface of the intermediate transfer drum 7 after a toner image is transferred to the paper sheet 10. An optical reflection density sensor 18 is provided to detect the quantity of light (the quantity of attached toner) reflected on a reference test pattern toner image (for controlling the image forming condition) and a test pattern toner image 19 (for detecting the detection characteristics of the reflection density sensor) which are formed on the surface of the intermediate transfer drum 7. Besides the above means, the image forming apparatus also contains a controller 20 to control the formation of images and each driving system.

In this embodiment 1, the intermediate transfer drum 7 operates as an image retainer.

The color developer 6 is a dry developer containing powder toner as color particles. Developers 6*a*, 6*b*, 6*c*, and 6*d* respectively carry yellow, magenta, cyan, and black toners in this order. Each of the developers 6*a*, 6*b*, 6*c*, and 6*d* is usually retracted away from the endless photosensitive belt 2. When a latent image of a color on the endless photosensitive belt 2 comes to the developing position, the developer for that color moves toward the developing position to develop the latent image.

Figure 2:
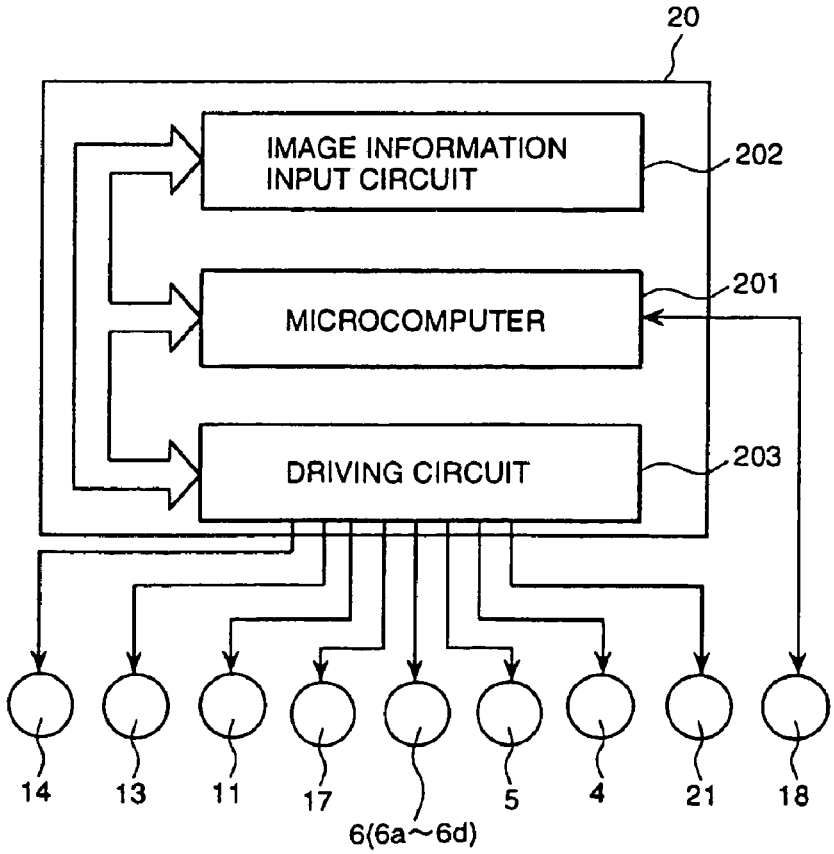
FIG. 2 is a functional block diagram of the control system of FIG. 1

As shown in FIG. 2, the controller 20 is basically equipped with an image information input circuit 202 and a driving circuit 203. The microcomputer 201 executes a pre-installed image formation control program and controls the driving circuit 203 to input a detection output received from the reflection density sensor 18, to input recording image information from a host apparatus (not shown in the figure) through the image information input circuit 202, to implement an electrophotographic process, and record a recording image.

To implement this electrophotographic process, the driving circuit 203 performs the drive control as explained below.

The driving circuit 203 performs the steps of controlling the main driving motor 21 to rotate the endless photosensitive belt 2 and the intermediate transfer drum 7, causing the charger 4 to evenly charge the surface of the endless photosensitive belt 2, controlling the laser exposure 5 to expose the surface of the endless photosensitive belt 2 according to the recording image information and to form an electrostatic latent image of a selected color toner color, selectively causing a color developer 6 (6*a* to 6*d*) containing toner of a color corresponding to the color of the latent image formed on the surface of the endless photosensitive belt 2 to develop the latent image into a toner image, and transferring the toner image from the endless photosensitive belt 2 to the intermediate transfer drum 7 in the area between the guide rollers 3*c* and 3*d*. In the recording of a color image, the controller keeps the transfer roller 13 and the drum cleaner 17 in a retracted state, forms toner images of colors in sequence on the endless photosensitive belt 2 and transfers the toner images from the endless photosensitive belt 2 onto the surface of the intermediate transfer drum 7 to form a single multi-color image on the drum 7.

After a toner image of the required colors is formed on the intermediate transfer drum 7, the driving circuit 203 further operates to drive the feed roller 11 to take out a recording sheet 10 from inside the paper feed tray 9, transports the sheet 10 toward the toner image transfer position 7*a* so that the sheet 10 reaches a position where it can receive the toner image on the intermediate transfer drum 7, moves the transfer roller 13 to press the sheet 10 against the intermediate transfer drum 7 when the sheet 10 touches the surface of the intermediate transfer drum 7 at the toner image transfer position 7*a*, and causes the transfer roller 13 to generate a transferring electric field. With this, the color toner image is transferred from the intermediate transfer drum 7 to the sheet 10.

Another transferring method, such as a pressure-transfer method and a corona transfer method, can be used to transfer a color toner image from the intermediate transfer drum 7 to the sheet 10. After the toner image is transferred onto the sheet 10, the drum cleaner 17 is moved toward the drum 7 to remove the left-over toner from the drum surface.

After passing through the toner image transfer position 7*a*, the sheet 10 on which the image has been transferred separates from the intermediate transfer drum 7 and enters the fixer 14. The fixer 14 heats the sheet 10 and the toner image on the sheet 10 to fix the toner image and ejects the fixed sheet to the outside of the image forming apparatus.

Prior to the implementation of this electrophotographic process to form images, the image forming apparatus 1 forms a test-pattern toner image 19 for controlling the image forming condition on the intermediate transfer drum 7 by a similar electrophotographic process. The controller 20 detects the quantity of toner on the test-pattern toner image 19 using the reflection density sensor 18, and it controls the image forming condition for image recording as a result of this detection. In other words, the controller implements the control processing by detecting the detection characteristics of the reflection density sensor 18 and calibrating the detection output characteristic of the reflection density sensor so that the quantity of the attached toner may be detected at a high precision from the detection output of the reflection density sensor 18. Here, "calibration of the detection output characteristics" includes "adjusting the reflection density sensor 18 to output exact detection output signals," "converting the detection output signal from the reflection density sensor 18 into an exact detection output signal by multiplying it by a coefficient," and "changing a coefficient for controlling the image forming condition by the detection output signal output from the reflection density sensor 18."

Calibration of the detection output characteristics of the optical reflection density sensor 18 will be explained below. The optical reflection density sensor 18 consists of a light emitting diode LED (not shown in the figure), which emits invisible light and illuminates a test-pattern toner image 19, and a photo detector (PD), which is an element used to detect the invisible light reflected on the test-pattern toner image 19. The sensor 18 is provided at a position located opposite to the path of the test-pattern toner image 19, which is formed on the intermediate transfer drum 7 and which moves together with the drum 7. The light-receiving sensitivity (detection output characteristics) of the PD of the reflection density sensor can be controlled by adjusting the current fed to the LED.

The controller 20 determines a required current of the LED sufficient to illuminate the intermediate transfer drum 7, actuates the reflection density sensor with this LED current, and obtains a detection output signal of light reflected on the surface of the intermediate transfer drum 7.

Then, the controller 20 implements the electrophotographic process, forms an electrostatic latent image of the test-pattern for detecting the detection characteristics of the reflection density sensor on the photosensitive endless belt, develops this electrostatic latent image, transfers the formed toner image onto the surface of the intermediate transfer drum 7, and forms a test-pattern toner image 19 for detecting the detection characteristics of the reflection density sensor.

The test pattern toner image 19 consists of multiple toner layers corresponding to superimposed toner images of a plurality of colors (to be explained later). When the test pattern toner image 19 moves to a location just opposite the reflection density sensor 18, the controller receives a detection output signal from the reflection density sensor 18. This detection signal is used for calibration as follows.

One of the methods for calibrating the detection characteristics is to control the current supplied to the LED to produce a detection output signal of light reflected on the test pattern toner image 19 (for detecting the detection characteristics of the reflection density sensor) which is equal to a preset value.

Another method is to calculate a difference (error rate "a") between a preset value to be output from the reflection density sensor 18 (opposite to the test pattern toner image 19) and a detection output signal which is actually output from the reflection density sensor 18 when the toner image 19 moves to a location just opposite the reflection density sensor, and to compute the error rate "a" for the succeeding detection output signal.

In this case, the error rate "a" is expressed by:

$$\text{“}a\text{”}=V\text{mark}/V\text{mes}$$

where Vmark is a value output from the reflection density sensor 18 located opposite to the test pattern toner image 19 (for detecting the detection characteristics of the reflection density sensor), and Vmes is a value of the actual output detection output signal.

The detection output signal value V after calibration is expressed by:

$$V=V\text{out}\times\text{“}a\text{”}$$

where Vout is the value of the detection output signal of the reflection density sensor 18.

Still another method is to use a detection output signal of light reflected on a blank area having no toner image on the intermediate transfer drum 7 in addition to the above-described calibration method. This calibration method calibrates the LED current of the reflection density sensor 18 and causes the reflection density sensor 18 to re-detect light reflected on a blank area having no toner image on the intermediate transfer drum 7. This detected value is Vbase.

The calibration of the detection output signal uses a ratio of a preset value Vmark (output from the reflection density sensor 18 at a location opposite to the test pattern toner image 19 for detecting the detection characteristics of the reflection density sensor) to the detection output value Vbase obtained from the blank area of the intermediate transfer drum 7. The value V of the detection output signal after calibration is expressed by:

$$V=(V\text{out}-V\text{base})/(V\text{mark}-V\text{base})$$

After calibrating the reflection density sensor 18, this method forms a test-pattern toner image 19 for controlling the image forming condition under the developing and transferring conditions required to control the image density. Then, this method detects the quantity of the attached toner from the detection output signal of the reflection density sensor and determines the image forming conditions for image recording according to the result of detection.

Next, we will explain the test-pattern toner image 19 which is used for detecting the detection characteristics of the reflection density sensor 18 for calibration of the sensor 18. This test-pattern toner image 19 is required to have much more toner than the test pattern toner image 19 (for detecting the detection characteristics of the reflection density sensor) which is used to control the image density (image forming condition) of recorded images.

Figure 3:
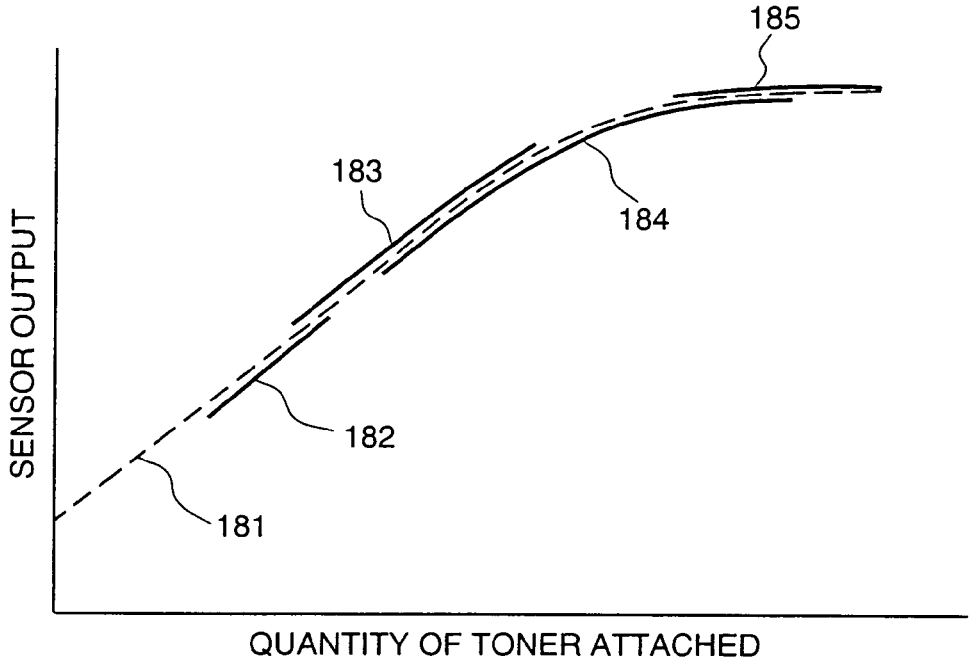
FIG. 3 is a graph showing the relationship between the quantity of attached color toner and the output of the optical reflection density sensor in accordance with this invention.

FIG. 3 shows an example of the characteristics of the detection output of the reflection density sensor 18 versus the quantity of attached color toner. The dotted line 181 represents a characteristic curve of the detection output of the reflection density sensor 18 versus the quantity of color toner. The solid line 182 represents a characteristic curve of the detection output of the reflection density sensor 18 versus the quantity of color toner on the test pattern toner image 19 (for detecting the detection characteristics of the reflection density sensor) which contains a single toner image layer. The solid line 183 represents a characteristic curve of the detection output of the reflection density sensor 18 versus the quantity of color toner on the test pattern toner image 19 (for detecting the detection characteristics of the reflection density sensor) which contains two toner image layers. The solid line 184 represents a characteristic curve of the detection output of the reflection density sensor 18 versus the quantity of color toner on the test pattern toner image 19 (for detecting the detection characteristics of the reflection density sensor) which contains three toner image layers. The solid line 185 represents a characteristic curve of the detection output of the reflection density sensor 18 versus the quantity of color toner on the test pattern toner image 19 (for detecting the detection characteristics of the reflection density sensor) which contains four toner image layers. These detection output characteristics are obtained because the color toners (yellow, magenta, and cyan toners) used by the developers 6*a* to 6*c* to record color images exhibit similar reflection characteristics when using invisible light in the optical reflection density sensor.

So, in order to reliably form a test pattern toner image 19 (for detecting the detection characteristics of the reflection density sensor) having enough toner, we prepared the test pattern toner image 19 for this embodiment by adjusting the development parameters to make a single toner layer contain more toner than usual (e.g. by increasing the developing bias, reducing the processing speed, or increasing the toner supply) and superimposing two or more of such toner images.

Here, we will explain a method of reliably forming a test pattern toner image 19 (for detecting the detection characteristics of the reflection density sensor) whose toner quantity is stable.

Figure 4:
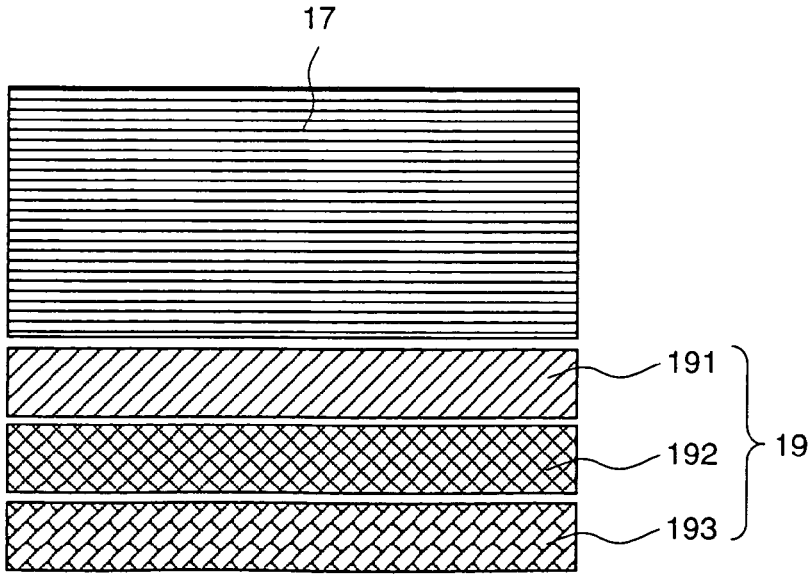
FIG. 4 is a cross-sectional view of multi-toner layers of the test-pattern toner image used for detecting the detection characteristics of the reflection density sensor in accordance with this invention.

FIG. 4 is a cross-sectional view of the multi-toner layers of the test-pattern toner image 19 for detecting the detection characteristics of the reflection density sensor. The element 7 represents the intermediate transfer drum. The layer 191 represents the first toner layer formed (transferred) on the surface of the intermediate transfer drum. The layer 192 represents the second toner layer formed (transferred) on the surface of the intermediate transfer drum. The layer 193 represents the third toner layer formed (transferred) on the surface of the intermediate transfer drum. In the image forming apparatus 1 of FIG. 1, the time period to form such a test pattern toner image 19 (for detecting the detection characteristics of the reflection density sensor) of three different colors is almost the same as that of a test pattern toner image of a single color.

When black toner is used to form such a test pattern toner image (for detecting the detection characteristics of the reflection density sensor), the toner image formed of black toner must be placed on the top of the multi-layer color image.

As explained above, by preparing a test pattern toner image 19 (for detecting the detection characteristics of the reflection density sensor) by superimposing toner images of different colors, we can prevent a reduction in the quantity of attached toner when the developers 6*a* to 6*c* fall in their developing abilities and further correct uneven toner consumption of the developers 6*a* to 6*c*.

The developers 6*a* to 6*c* that are actually used to form a test pattern toner image 19 (for detecting the detection characteristics of the reflection density sensor) should preferably be controlled individually according to detection signals from their toner quantity indicators (not shown in the figure) that are provided as a standard.

When a developer whose toner supply is very little (indicated "Almost empty" or "Empty" by its toner quantity indicator) is used to develop an electrostatic latent image for formation of a test pattern toner image 19 (for detecting the detection characteristics of the reflection density sensor), the toner image 19 may have insufficient toner. In such a case, we can form a stable toner image having enough toner by using only developers storing enough toner, instead of using developers whose toner quantity indicators indicate "Almost empty" or "Empty", and developing an electrostatic latent image for formation of a test pattern toner image 19 (for detecting the detection characteristics of the reflection density sensor).

FIG. 5 shows an example of a control table representing combinations of colors constituting the test-pattern toner image 19 for detecting the detection characteristics of the reflection density sensor. Combinations of colors of toner image layers are dependent upon the number of toner image layers and the number of colors. In actual cases, color combinations are determined as follows:

When an image is to be formed with three toner-image layers, toner image layers of three colors are basically used and arranged in an order in which the developers 6*a* to 6*c* can develop and superimpose toner images efficiently. If one of the developers 6*a* to 6*c* is almost empty, we use two non-empty developers once and one of these non-empty developers once more to form the three toner-image layers without using the almost-empty developer. If two of the developers 6*a* to 6*c* are almost empty, we use the remaining non-empty developer three times to form the three toner-image layers without using the almost-empty developers.

When an image is to be formed with two toner-image layers, we use two developers 6*a* to 6*c* whose colors are stable with time and environmental change to form the two toner image layers. If one of the selected developers is almost empty, we use two non-empty developers to form the two toner-image layers. If the two selected developers are almost empty, we use the remaining non-empty developer twice to form the two toner-image layers in a manner similar to the formation of a three-layer image.

[Embodiment 2]

Figure 6:
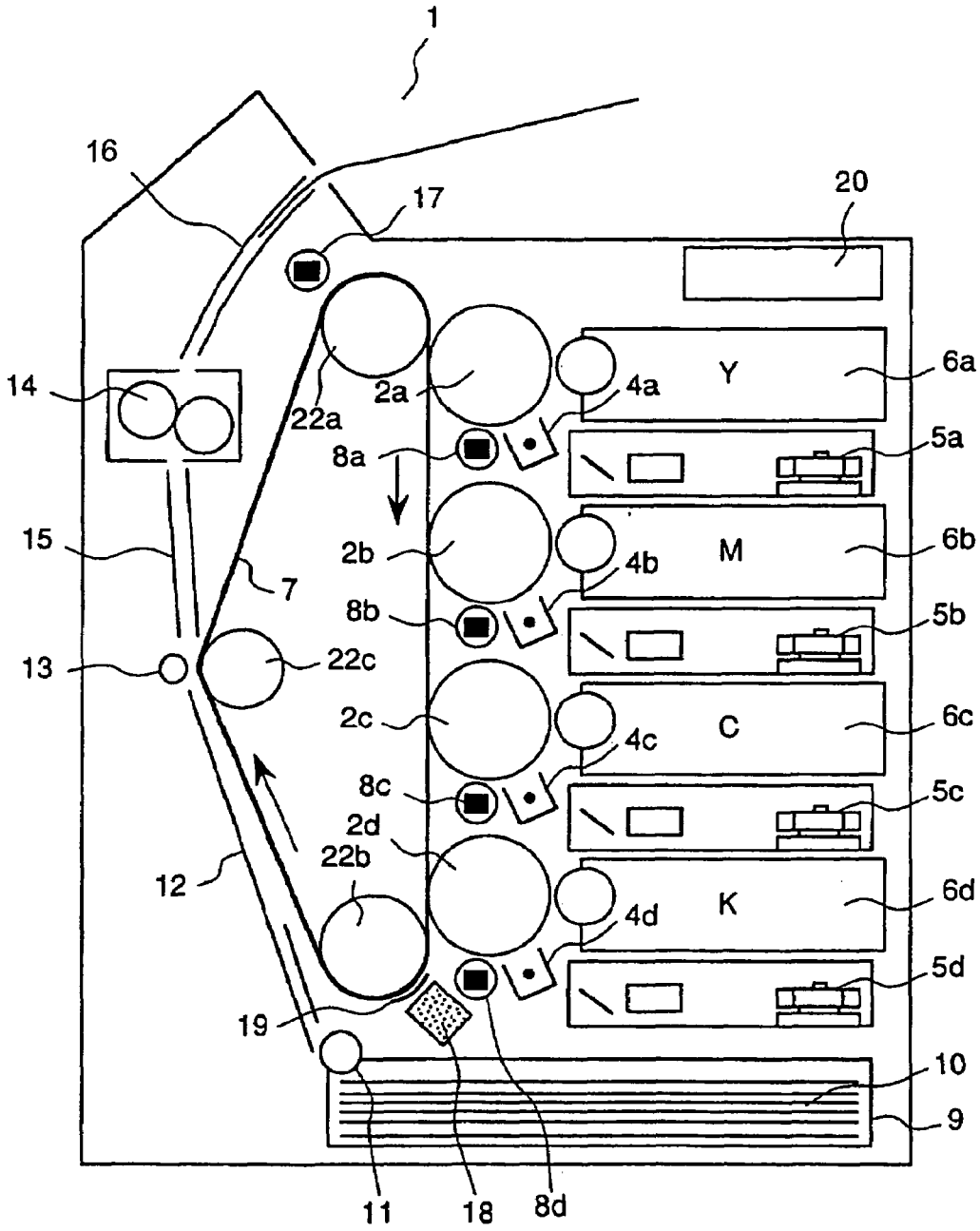
FIG. 6 is a diagrammatic sectional view of an image forming apparatus representing a second embodiment of this invention.

FIG. 6 is a diagrammatic sectional view of an image forming apparatus representing a second embodiment of this invention. This image forming apparatus is configured to record a multi-color image by transferring toner images of multiple colors respectively formed by four photosensitive drums onto an intermediate transfer belt in a superimposed manner.

The image forming apparatus 1 of FIG. 6 is configured as follows. Embodiment 2 is basically the same as Embodiment 1 of FIG. 1, but Embodiment 2 uses a drum for each photosensitive developer, instead of the photosensitive endless belt, and it also uses an intermediate transfer belt instead of an intermediate transfer drum.

In other words, the image forming apparatus 1 has a plurality of photosensitive drums 2*a* to 2*d*. Each photosensitive drum (2*a* to 2*d*) has a charger (4*a* to 4*d*) that evenly charges the surface of the respective photosensitive drum, a laser exposure unit (5*a* to 5*d*) that exposes the evenly-charged photosensitive drum (2*a* to 2*d*) to form an electrostatic latent image in the form of a recording image or a test pattern image thereon, and a color developer (6*a* to 6*d*) that develops the electrostatic latent image into a visible toner image on the surface of the photosensitive drum (2*a* to 2*d*). These photosensitive drums 2*a* to 2*d* are disposed almost linearly along one run of the intermediate transfer belt 7. The intermediate transfer belt 7 is well tensioned by the guide rollers 22*a* to 22*c* provided in the internal side of the belt 7 so as to move in contact with the photosensitive drums 2*a* to 2*d*. In this configuration, toner images respectively formed on the photosensitive drums 2*a* to 2*d* are transferred to the intermediate transfer belt 7. After the toner images are transferred from the photosensitive drums 2*a* to 2*d* to the intermediate transfer belt, the left-over toner on each photosensitive drum (2*a* to 2*d*) is removed by the drum cleaner (8*a* to 8*d*). The paper feeding mechanism for feeding recording sheets 10 is similar to that of FIG. 1 and will not be explained here. A recording sheet 10 fed out by the feed roller 11 is delivered to the toner image transfer position set by the guide roller 22*c* until it touches the surface of the intermediate transfer belt 7. At the toner image transfer position, the sheet 10 is pressed against the guide roller 22*c* by the transfer roller 13 provided opposite to the guide roller 22*c* and receives toner images by static electricity applied to the transfer roller. The image-transferred recording sheet 10 is then transported to the fixer 14, heated and fixed by the fixer 14, and sent out of the image forming apparatus through the paper ejection guide 15. The toner left on the surface of the intermediate transfer belt 7 is removed by a retractable belt cleaner 17. A reflection density sensor 18 is provided adjacent to the intermediate transfer belt 7 to detect the quantity of optical reflection as the quantity of attached toner. In this embodiment 2, the intermediate transfer belt 7 works as an image retainer.

The color developer 6 is a dry developer using powder toner as color particles. Developers 6*a*, 6*b*, 6*c*, and 6*d* respectively use yellow, magenta, cyan, and black toners in this order.

The controller 20 is configured similarly to the Embodiment of FIG. 2 and performs the image formation control indicated below.

The controller 20 performs the steps of evenly charging the surfaces of the photosensitive drums 2*a* to 2*d* by means of the chargers 4*a* to 4*d* after the drum surfaces are cleaned by the drum cleaners 8*a* to 8*d*, exposing the surfaces of the photosensitive drums 2*a* to 2*d* by the laser exposure units 5*a* to 5*d* according to image information to form electrostatic latent images of relevant colors, and developing the latent images of the colors on the photosensitive drums 2*a* to 2*d* by developers 6*a* to 6*d* into toner images of relevant colors. The controller 20 performs these steps independently and in parallel for each color. The toner images of relevant colors are transferred onto the intermediate transfer belt 7 sequentially in the order of the arrangement of the developers 6*a* to 6*d* to form a multi-color toner image on the intermediate transfer belt 7.

The multi-color toner image on the intermediate transfer belt 7 is transferred to a recording sheet which is taken up and delivered from the paper feed tray 9, heated and fixed to the sheet by the fixer 14. The fixed sheet is ejected out of the image forming apparatus.

During image recording, the belt cleaner 17 is in contact with the intermediate transfer belt 7 to clean the belt (to remove left-over toner and contaminants). However, when the detection characteristics of the reflection density sensor 18 are detected, or when an image forming condition is set (to control the image density) for image recording, the belt cleaner 17 is retracted away from the intermediate transfer belt 7 so as not to disturb the reference test pattern image for controlling the image forming condition or the test pattern image for detecting the detection characteristics of the reflection density sensor on the intermediate transfer belt 7. The detection characteristics of the reflection density sensor are detected in a manner similar to that of Embodiment 1.

Since the image forming apparatus 1 of Embodiment 2 forms toner-image layers of different colors, the time required to form a three-color toner image can be reduced to one third of the time period required to prepare three toner images individually and superimpose them into one three-color image.

The image forming apparatus 1 of Embodiment 2 has the same effect as that of Embodiment 1.

[Embodiment 3]

Figure 7:
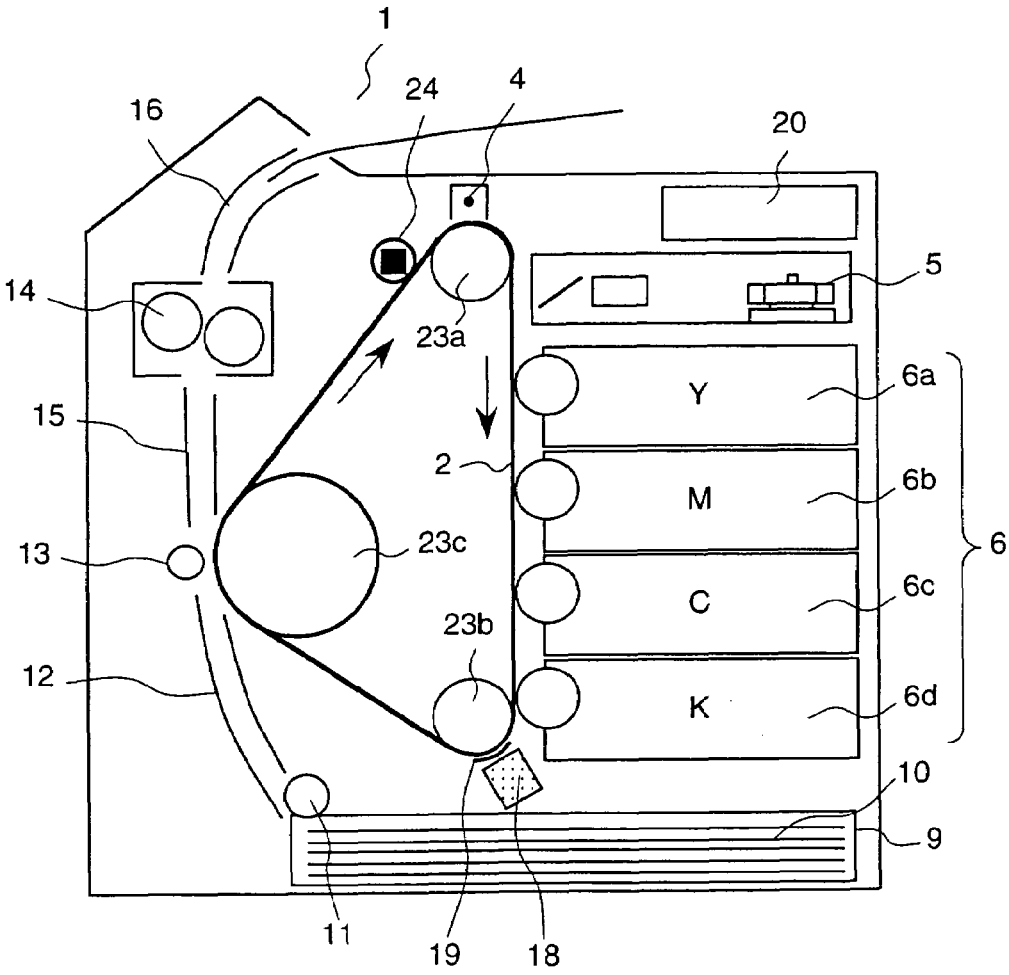
FIG. 7 is a diagrammatic sectional view of an image forming apparatus representing a third embodiment of this invention.

FIG. 7 is a diagrammatic sectional view of an image forming apparatus representing a third embodiment of this invention. This image forming apparatus forms and superimposes each toner image of a different color into a single multi-color toner image on the endless photosensitive belt 2 and transfers the resulting multi-color toner image onto a recording sheet.

The image forming apparatus 1 of FIG. 7 is almost the same as that of FIG. 6, but this embodiment forms each toner image of a different color by means of respective developers 6*a* to 6*d*, superimposes them into a single multicolor toner image on the photosensitive belt 7, and transfers the resulting multi-color toner image onto a recording sheet without using an intermediate transfer belt 7. As shown in FIG. 7, the endless belt 2 is tensioned by guide roller 23*a*–23 *c*, and is also rotated by guide rollers 23*a*–23*c*. This configuration without an intermediate transfer belt or drum provides for a reduction in the size of the apparatus. In this configuration, the photosensitive endless belt 2 operates as an image retainer. The other components of this embodiment are similar to those of embodiment 1 of FIG. 1 or embodiment 2 of FIG. 6 and will not be explained here.

The color developer 6 is a dry developer using powder toner as color particles. The developers 6*a*, 6*b*, 6*c*, and 6*d* respectively use yellow, magenta, cyan, and black toners in this order.

The controller 20 is configured similarly to that of the Embodiment of FIG. 2 and performs the image formation control below.

The controller 20 performs the steps of moving the endless photosensitive belt 2, cleaning the endless photosensitive belt 2 by use of the belt cleaner 24, retracting the belt cleaner 24 away from the endless photosensitive belt 2, evenly charging the surface of the endless photosensitive belt 2 by use of the charger 4, exposing the surface of the endless photosensitive belt 2 by means of the laser exposure unit 5 according to image information to form an electrostatic latent image of a first color (e.g. yellow), moving the developer 6*a* of the color (e.g. yellow) to develop the yellow toner image on the endless photosensitive belt 2, and repeating these steps to respectively form toner images of the other colors on the yellow toner image on the endless photosensitive belt 2.

The multi-color toner image on the endless photosensitive belt 2 is transferred to a recording sheet 10, which is transported up and delivered from the paper feed tray 9, heated and fixed to the sheet by the fixer 14. The fixed sheet is ejected out of the image forming apparatus.

The belt cleaner 24 is moved so as to be in contact with the belt cleaner 24 to remove toner left on the endless photosensitive belt 2 after the toner image is transferred to the recording sheet 10.

When the detection characteristics of the reflection density sensor 18 are detected, or when an image forming condition is set (to control the image density) for image recording, the reference test pattern image for controlling the image forming condition or the test pattern image for detecting the detection characteristics of the reflection density sensor is formed in a similar manner. The detection characteristics of the reflection density sensor 18 are detected also in a manner similar to that of Embodiment 1.

The image forming apparatus 1 of Embodiment 3 has the same effect as that of Embodiment 1.

Although the image forming apparatus of each embodiment employs a dry electrophotographic method, this invention is applicable to an image forming apparatus using a wet electrophotographic method as well.

The invention claimed is:

1. An image forming apparatus comprising an image retainer, a charger, an exposure unit, a plurality of developers, toner quantity indicators, an optical reflection density sensor, and a controller that operates to control image forming conditions by controlling the image retainer, the charger, the exposure unit, and the developers under a preset reference image forming condition to form a reference test-pattern toner image for controlling the image forming condition on the image retainer, by detecting a quantity of toner attached to the resulting reference test-pattern toner image from the output of the optical reflection density sensor, and by using a result of detection for control of a succeeding image forming condition, the controller being configured to form a test-pattern toner image for calibration of reflection density detection characteristics made by superimposing a plurality of toner images of different colors on the image retainer by the developers aside from the reference test-pattern toner image for controlling image forming conditions, to detect the quantity of toner attached to the test-pattern toner image for calibration of reflection density detection characteristics by the optical reflection density sensor, to calculate the detection characteristics of the optical reflection density sensor from the result of detection, and to calibrate the detection output characteristics of the optical reflection density sensor by the result of detection, wherein said controller controls said developer to form the test pattern toner image for calibration of the detection characteristics of the optical reflection density sensor by superimposing the plurality of toner images on the image retainer based on a detection signal from said toner quantity indicator and calibrates the detection output characteristics of the optical reflection density sensor by using the test pattern toner image for the detection characteristics of the optical reflection density sensor.

2. The image forming apparatus of claim 1, wherein the optical reflection density sensor further comprises a light source which emits invisible light, and an element for detecting the invisible light and the developers are configured to form a color toner image.

3. The image forming apparatus of claim 2, wherein one of the developers contains black toner, and the controller effects control to form a black toner image on the top of the toner layers of the test-pattern toner image for calibration of reflection density detection characteristics.

4. The image forming apparatus according to claim 1, wherein said controller puts said developer to its proper use to form the test pattern toner image for the detection characteristics of the optical reflection density sensor by superimposing the plurality of toner images, which are formed by using only developers storing enough toner among the plurality of developers, on the image retainer by referring to a detection signal from said toner quantity indicator and calibrates the detection output characteristics of the optical reflection density sensor by using the test pattern toner image for the detection characteristics of the optical reflection density sensor.

5. the image forming apparatus according to claim 1, wherein said controller provides a developing and transferring condition necessary for the image density control after the calibration has finished, and detects an attached toner quantity of the reference test-pattern toner image for controlling the image forming conditions according to the detection output of the optical reflection density sensor, and further establishes the image forming conditions for after that image recording according to a result of the detection output.

6. A method of detecting the detection characteristics of an optical reflection density sensor in an image forming apparatus comprising an image retainer, a charger, an exposure unit, a plurality of developers, toner quantity indicators, an optical reflection density sensor, and a controller that is designed to control the image retainer, the charger, the exposure unit, and the developers to perform the steps of:

electrophotographically forming a test-pattern toner image for detecting the detection characteristics of the optical reflection density sensor on the image retainer under a preset reference image forming condition, detecting the detection characteristics of the optical reflection density sensor by the detection output of the optical reflection density sensor that, detects the quantity of toner attached to the test-pattern toner image for detecting the detection characteristics of the optical reflection density sensor, calibrating the detection output characteristics of the optical reflection density sensor from the result of detection; and superimposing multiple toner images formed by the developers; wherein the controller controls said developer to form the test pattern toner image for the detection characteristics of the optical reflection density sensor by superimposing the plurality of toner images on the image retainer based on a detection signal from said toner quantity indicator and calibrates the detection output characteristics of the optical reflection density sensor by using the test pattern toner image for the detection characteristics of the optical reflection density sensor.

7. The method of detecting the detection characteristics of an optical reflection density sensor of claim 6, wherein:

the optical reflection density sensor consists of a light source which emits invisible light and an element for detecting the invisible light; and the step of electrophotographically forming a test-pattern toner image comprises a step of electrophotographically forming a color test-pattern toner image.

8. The method of detecting the detection characteristics of an optical reflection density sensor of claim 6, further comprising a step of forming a black toner image on top of the toner layers of the test-pattern toner image.

* * * * *